US006097923A

United States Patent [19]

Iwakura et al.

[11] Patent Number: 6,097,923

[45] Date of Patent: Aug. 1, 2000

[54] IMAGE FORMING METHOD AND APPARATUS

[75] Inventors: Yoshie Iwakura; Seiichi Yoshida, both of Nara; Hideki Ohnishi, Chiba; Fumio Shimazu, Nara, all of Japan

[73] Assignee: Sharp Kabushiki Kaisha, Osaka, Japan

[21] Appl. No.: 09/042,021

[22] Filed: Mar. 13, 1998

[30] Foreign Application Priority Data

Mar. 14, 1997 [JP] Japan ..... 9-060251

[51] Int. Cl.[7] ..... G03G 15/16

[52] U.S. Cl. ..... 399/313; 399/303

[58] Field of Search ..... 399/297, 303, 399/310, 313, 314, 316

[56] References Cited

U.S. PATENT DOCUMENTS

| | | | |
|---|---|---|---|
| 5,132,737 | 7/1992 | Takeda et al. | 399/303 |
| 5,287,163 | 2/1994 | Miyashiro et al. | 399/303 X |
| 5,390,012 | 2/1995 | Miyashiro et al. . | |
| 5,398,107 | 3/1995 | Bartholmae et al. | 399/297 X |
| 5,438,398 | 8/1995 | Tanigawa et al. . | |
| 5,623,329 | 4/1997 | Yamauchi et al. | 399/314 |
| 5,697,034 | 12/1997 | Iwakura et al. | 399/313 |
| 5,771,430 | 6/1998 | Iwakura et al. | 399/314 X |

FOREIGN PATENT DOCUMENTS

| | | |
|---|---|---|
| 0548803-A1 | 12/1992 | European Pat. Off. . |
| 0684613-A2 | 5/1995 | European Pat. Off. . |
| 0700055-A2 | 3/1996 | European Pat. Off. . |
| 0708385-a2 | 4/1996 | European Pat. Off. . |
| 0737901-A2 | 10/1996 | European Pat. Off. . |
| 8-334990 | 12/1996 | Japan . |

*Primary Examiner*—Sandra Brase

[57] ABSTRACT

When a grounded conductive roller touches a transfer drum through a transfer material while a voltage is applied to a conductor layer, charges having a polarity opposite to the polarity of the voltage applied to the conductor layer are generated over the transfer material, thereby making it possible to attract the transfer material to the dielectric layer. Since the voltage is applied to the conductor layer, the electrostatic attraction of the transfer material and the toner transfer can be carried out using a single power source. Moreover, since the attraction of the transfer material and the toner transfer are carried out by the charge injection, a lower voltage can be used. Thus, the voltage can be readily controlled while reducing the ozone emission to a relatively low level. Furthermore, since the toner transfer and electrostatic attraction of the transfer material can be carried out using a single power source, the apparatus can be downsized and less expensive. In addition, when a semiconductor layer is made of a solid elastic body, a high-quality transferred toner image can be obtained without image quality deterioration.

2 Claims, 15 Drawing Sheets

CONFIGURATION
OF ONE FIBER

ILLUSTRATION OF GIVING IRREGULARITIES TO DIELECTRIC LAYER

BUNDLE OF FIBERS

IMAGE FORMING METHOD AND APPARATUS

FIELD OF THE INVENTION

The present invention relates to an electrophotographic recording apparatus, more particularly, to an image forming apparatus furnished with a transfer device for transferring a toner image formed on an image carrier onto a transfer material, such as a transfer sheet, and to an image forming method.

BACKGROUND OF THE INVENTION

In the first place, a conventional transfer drum will be explained. An image forming apparatus which develops an electrostatic latent image formed on a photosensitive drum with toner, and then transfers a resulting toner image onto a transfer material wound around a transfer drum is known. In this type of image forming apparatus, as shown in FIG. 15, for example, a corona charger 102 for attracting a transfer material P and another corona charger 104 for transferring a toner image formed on the surface of a photosensitive drum 103 onto the transfer material P are separately provided in a cylinder 101 having a dielectric layer 101*a*, so that the attraction of the transfer material P and the transfer are carried out separately by these chargers 102 and 104.

However, in the image forming apparatus shown in FIG. 15, since the cylinder 101 serving as a transfer roller is of a single-layer structure having only the dielectric layer 101*a*, two corona chargers 102 and 104 must be provided inside the cylinder 101.

On the other hand, another type of image forming apparatus as shown in FIG. 16 is also known, which is furnished with a cylinder 201 of a double-layer structure having an outer semiconductor layer 201*a* and an inner base material 201*b*, and a grip mechanism 202 for holding the transported transfer material P along the surface of the cylinder 201. In this type of image forming apparatus, the end portion of the transported transfer material P is sandwiched by the grip mechanism 202 so as to be held along the surface of the cylinder 201, and the surface of the cylinder 201 is charged either by applying a voltage to the outer semiconductor layer 201*a* of the cylinder 201 or by triggering a discharge by means of a charger provided inside the cylinder 201, whereupon a toner image on the photosensitive drum 103 is transferred onto the transfer material P.

In the image forming apparatus shown in FIG. 16, since the cylinder 201 serving as a transfer roller is of the double-layer structure to charge the cylinder 201 when a toner image is transferred onto the transfer material P, the number of the chargers can be reduced.

Further, a conventional example will be explained with reference to Japanese Laid-open Patent Application No. 173435/1993 (Tokukaihei No. 5-173435, U.S. Pat. No. 5,390,012). This prior art proposes a transfer device for forming a color image on a transfer material. More specifically, the transfer device transfers a toner image of each color formed sequentially on an image carrier successively onto a transfer material carried by a transfer material carrier, composed of at least a foam body covered with a dielectric layer, so as to superimpose one toner image on another. In this prior art, electrostatic attraction by charge conferring means (attraction roller) is adopted as a carrying method of the transfer material over the transfer material carrier, and it is characterized by providing a space layer of at least 10 $\mu$m-thick between the dielectric layer and the foam body layer to improve the attraction ability. However, the larger the interval of the space, the higher the applied voltage to electrostatically attract the transfer material onto the dielectric body, which raises a safety problem and makes the transfer device disadvantageous in terms of costs.

To be more specific, when the interval of the space between the foam body and dielectric layer is roughly set to at least 10 $\mu$m as is in the above prior art, the interval of the space can be as small as some millimeters or as large as some meters. If the interval of the space is too large, the applied voltage for electrostatically attracting the transfer material to the transfer material carrier in a stable manner or a toner transferring voltage both applied during the toner transfer become so high that there arises a safety problem. Further, at least two power sources are necessary to carry out the electrostatic attraction of the transfer material to the transfer material carrier and the toner transfer stably in a satisfactory manner. Thus, the device may be undesirably upsized or become expensive.

In addition, when the foam body is used as the semiconductor layer provided between the dielectric layer and conductor layer, there occurs a transfer defect at a foam portion of the semiconductor layer on the side touching the dielectric layer, and the toner density at that particular portion drops. Consequently, unwanted spots appear on the resulting toner image transferred onto the transfer material, thereby deteriorating the image quality. This phenomenon is particularly noticeable on a half-tone image.

Further, under high temperature and high humidity circumstances, water drops are collected in the space between the dielectric layer and semiconductor layer, whereas under low temperature and low humidity circumstances, the interval of the space is reduced. Nevertheless, the above prior art is silent about the countermeasures to the image quality deterioration caused by the change in circumstances and to the change in circumstances itself, and therefore, a satisfactory image quality may not be maintained when the state of the space changes in response to the change in circumstances.

SUMMARY OF THE INVENTION

It is therefore an object of the present invention to provide an inexpensive, downsized image forming apparatus capable of obtaining a high-quality transferred toner image without image quality deterioration and an image forming method. To be more specific, it is an object of the present invention to provide an image forming apparatus, furnished with a transfer device which can attract a transfer material and transfer a toner image with the charge injection and carry out the electrostatic attraction of the transfer material and the toner transfer using the same power source, for preventing unwanted separation of the transfer material or defective transfer, and such an image forming method.

An image forming apparatus of the present invention is an image forming apparatus furnished with an image carrier on a surface of which a toner image is formed, and a transfer device for transferring the toner image onto a transfer material by bringing the transfer material into contact with the image carrier while electrically attracting and holding the transfer material, and to fulfill the above object, the image forming apparatus is characterized in that:

(I) the transfer device includes, (a) a dielectric layer, a semiconductor layer, and a conductor layer, which are sequentially layered vertically from a surface side touching the transfer material, (b) a grounded electrode member touching a surface of the dielectric layer at an upstream side from a transfer position through the transfer material, and (c) a voltage applying device for applying a certain voltage to the conductor layer; and (II) the semiconductor layer is a solid elastic body.

According to the above arrangement, when the grounded electrode member, such as a conductive roller, touches the transfer device, such as a transfer drum, through the transfer material while a voltage is applied to the conductor layer, charges having a polarity opposite to the polarity of the voltage applied to the conductor layer are generated on the transfer material. Consequently, the transfer material can be electrostatically attracted to the dielectric layer. Here, since the voltage is applied to the conductor layer, the electrostatic attraction of the transfer material and the toner transfer can be carried out using the same power source.

According to the above arrangement, different from the prior art where the attraction of the transfer material and the transfer are carried out by the charge injection to a transfer material carrier through an aerial discharge, the attraction of the transfer material and the transfer are carried out by injecting the charges to the transfer material through the contact charging. Thus, a lower voltage can be used, and so the voltage can be readily controlled; moreover, the ozone emission can be suppressed to a relatively low level. Further, since the toner transfer and electrostatic attraction of the transfer material can be carried out using a single power source, the apparatus can be downsized and less expensive.

Also, since the semiconductor layer is a solid body which is stronger against the change in circumstances compared with a foam body, when the charges injected to the transfer material attenuate, the attenuation rate characteristics can be maintained against the change in circumstances regardless of its elasticity. In addition, a constant voltage is always applied to the individual toner particles and transfer material during the transfer. Consequently, there can be attained an effect that a high-quality transferred toner image can be obtained without image quality deterioration. Examples of suitable materials for the semiconductor layer are urethane rubber and elastomer.

Also, the irregularities may be provided additionally to the dielectric layer on the surface touching the semiconductor layer. When arranged in this manner, a sufficient attraction effect can be obtained when the dielectric layer is made thinner compared with a case where the dielectric layer touches the semiconductor layer at a flat surface. Consequently, the transfer material electrostatically attracted to the dielectric layer can be kept attracted and held in a stable manner during the toner transfer, and a high-quality transferred toner image can be obtained without image quality deterioration by using the solid semiconductor layer.

When the irregularities are provided, it is more preferable that at least one of a distance between concave portions and a distance between convex portions of the irregularities provided to the dielectric layer on the surface touching the semiconductor layer is smaller than a toner particle size of the toner image formed on the image carrier. According to this arrangement, although the electrostatic attraction effect of the transfer material is improved by securing the microscopic space secured by the irregularities, the irregularities do not cause any change in the electrostatic force applied to the individual toner particles. Consequently, a high-quality transferred toner image without image quality deterioration nor inconsistencies of the density can be obtained.

Further, it is preferable that an average interval of the space secured by the irregularities provided to the dielectric layer on the surface touching the semiconductor layer is in a range between 20 $\mu$m and 50 $\mu$m. When arranged in this manner, the transfer material electrostatically attracted to the dielectric layer can be kept attracted and held in a stable manner during the toner transfer.

Also, regardless of whether the irregularities are provided to the dielectric layer or not, in the semiconductor layer and dielectric layer forming the transfer device, it is preferable that a width of the semiconductor layer in a rotating axis direction of the transfer device is smaller than a width of the dielectric layer, and an end portion of the semiconductor layer is covered with the dielectric layer. According to this arrangement, the collection of water drops between the layers under the high humidity circumstances can be prevented, and the stable electrostatic attraction characteristics can be maintained in any circumstance. Consequently, it has become possible to always carry out the toner transfer in a satisfactory manner.

In the above arrangement, it is preferable that a thickness of the dielectric layer is in a range between 75 $\mu$m and 300 $\mu$m when the irregularities are not provided, and in a range between 50 $\mu$m and 200 $\mu$m when the irregularities are provided. According to this arrangement, the adhesion between the semiconductor layer and dielectric layer can be maintained while suppressing the attenuation rate of the charges on the transfer material. Consequently, the transfer material electrostatically attracted to the dielectric layer can be kept attracted and held more stably during the toner transfer, while making it possible to obtain a further improved high-quality transferred toner image.

Also, it is preferable that a thickness of the semiconductor layer is in a range between 3 mm and 9 mm. According to this arrangement, the semiconductor layer can maintain not only the contact to the conductor layer, but also the durability, while the major diameter accuracy of the entire transfer device is maintained. Consequently, the toner transfer can be carried out more stably and a further improved high-quality toner image can be obtained.

Further, it is preferable that the volume resistivity of the semiconductor layer is in a range between $10^6$ Ωcm and $10^{11}$ Ωcm. According to this arrangement, the reverse transfer and defective transfer can be prevented during the toner transfer. Consequently, the toner transfer can be carried out more stably and a further improved high-quality toner image can be obtained.

On the other hand, an image method of the present invention is a method of forming a toner image on a surface of a transfer material by means of a transfer device including a dielectric layer, a semiconductor layer, and a conductor layer, which are sequentially layered vertically from a surface side touching the transfer material, a grounded electrode member maintained at a ground level, and an image carrier on which the toner image is formed, and to fulfill the above object, the image forming method is characterized by including the steps of:

forming a toner image on a surface of the image carrier;

applying a certain voltage to the conductor layer;

injecting charges to a surface of the transfer material by bringing the electrode member into contact with a surface of the dielectric layer at an upstream side from a transfer position through the transfer material;

maintaining characteristics of an attenuation rate of the charges injected at a constant level against changes in circumstances using the semiconductor layer made of a solid elastic body;

transporting the transfer material to the transfer position by electrically attracting and holding the transfer material with the charges injected; and transferring the toner image formed on the image carrier onto the transfer material by bringing the transfer material and image carrier into contact with each other at the transfer position.

According to the above method, since the attraction of the transfer material and the transfer are carried out by injecting the charges to the transfer material through the contact charging, a lower voltage can be used during the attraction and the transfer. Also, since the toner transfer and electrostatic attraction of the transfer material can be carried out using a single power source, the apparatus can be downsized and less expensive. Further, since the semiconductor layer is the solid elastic body, when the charges injected to the transfer material attenuate, the attenuation rate characteristics can be maintained at a constant level against the change in circumstances regardless of its elasticity. In addition, a constant voltage is always applied to the individual toner particles and transfer material during the transfer. Consequently, a high-quality transferred toner image can be obtained without image quality deterioration.

For a fuller understanding of the nature and advantages of the invention, reference should be made to the ensuing detailed description taken in conjunction with the accompanying drawings.

DESCRIPTION OF THE EMBODIMENTS

Referring to the accompanying drawings, the following description will describe an example embodiment of the present invention. In the following explanation, a transfer sheet is used as an example transfer material; however, other kinds of transfer materials, such as a film, can be used as well in the present invention.

Figure 3:
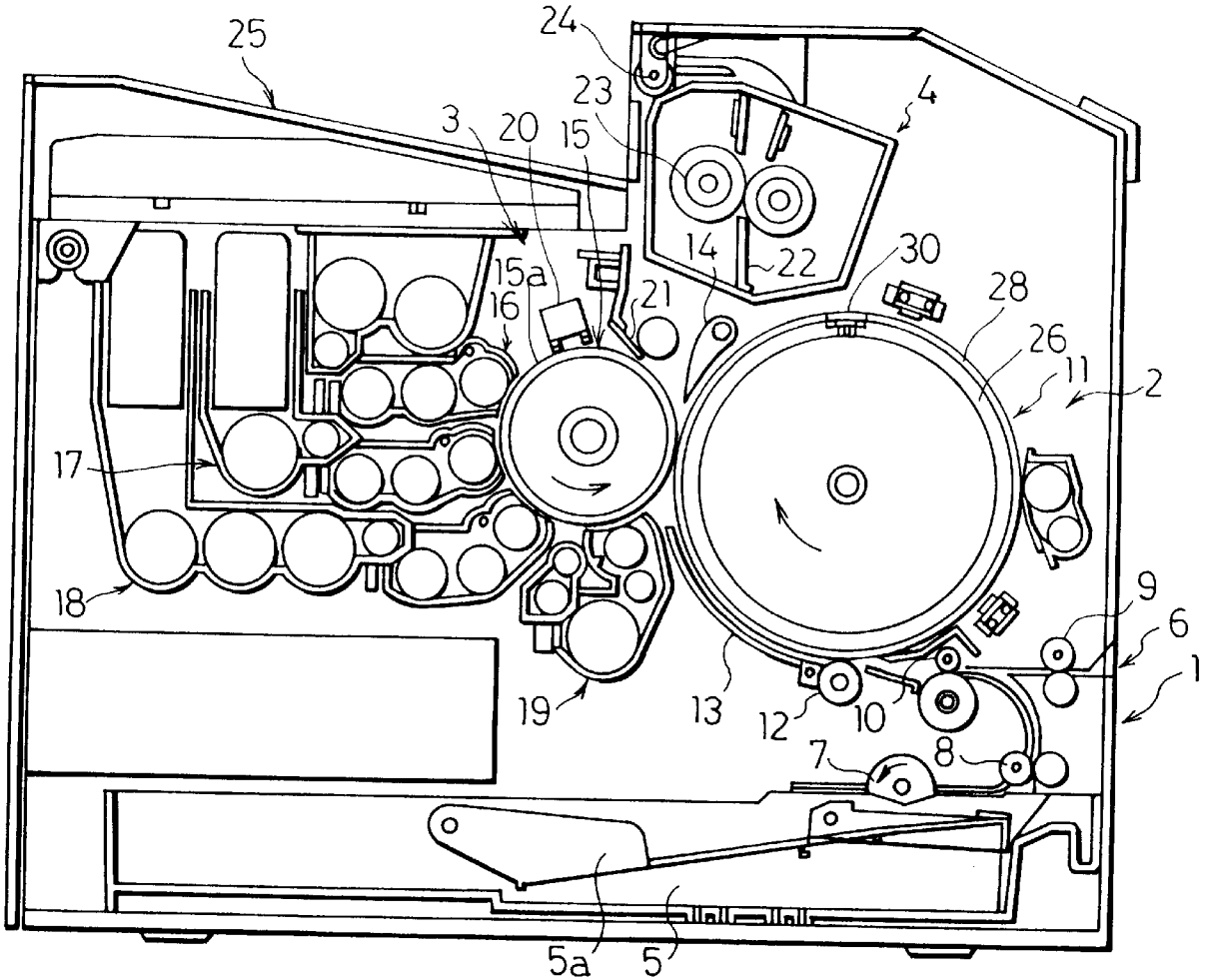
FIG. 3 is a view schematically showing an arrangement of a major portion of each of the above image forming apparatuses.

As shown in FIG. 3, an image forming apparatus in accordance with an example embodiment of the present invention includes a sheet feeding section 1 for stocking and feeding transfer sheets P (transfer materials) as recording sheets on each of which a toner image is formed, a transfer section 2 for transferring a toner image onto the transfer sheet P, a developing section 3 for forming a toner image, and a fixing section 4 for fusing a transferred toner image to fix the same onto the transfer sheet P. The transfer section 2 includes a transfer drum 11 as a transfer device.

Around the transfer drum 11, a ground roller as a grounded electrode member (or grounded semiconductor roller) 12 (hereinafter, these grounded members are collectively referred to as G.R.), a guiding member 13 for guiding the transfer sheet P so as not to fall off from the transfer drum 11, a separating claw 14 for forcibly separating the transfer sheet P from the transfer drum 11 to which the transfer sheet P is being attracted, etc. The separating claw 14 is provided so as to touch or keep a space from the surface of the transfer drum 11 flexibly.

Also, the developing section 3 includes a photosensitive drum 15 as an image carrier which is pressed against the transfer drum 11. The photosensitive drum 15 is composed of a grounded conductive aluminium element tube 15*a* whose surface is covered with an organic photoconductor (OPC).

Around the photosensitive drum 15, developers 16, 17, 18, and 19 respectively containing yellow, magenta, cyan, and black toners are provided radially, while a charger 20 for charging the surface of the photosensitive drum 15 and a cleaning blade 21 for scraping and removing residual toner on the surface of the photosensitive drum 15 are provided, so that a toner image of each color is formed on the photosensitive drum 15.

In other words, the photosensitive drum 15 is arranged to repeat the charging, exposing, developing, and transferring actions for each color. Thus, in case of the color transfer, a toner image of one color is transferred onto the transfer sheet P electrostatically attracted to the transfer drum each time the transfer drum 11 rotates, and a color image is obtained while the transfer drum 11 rotates up to four times.

The fixing section 4 includes a fixing roller 23 for fusing a toner image at certain temperature and pressure to fix the same on the transfer sheet P, and a fixing guide 22 for guiding the transfer sheet P to the fixing roller 23 after the transfer sheet P having thereon transferred the toner image is separated from the transfer drum 11 by the separating claw 14. In addition, a release roller 24 is provided at the downstream side of the fixing section 4 along a direction in which the transfer sheet P is transported, so that the transfer sheet P having the toner image fused thereon is released on a release tray 25 from the apparatus main body.

Figure 1:
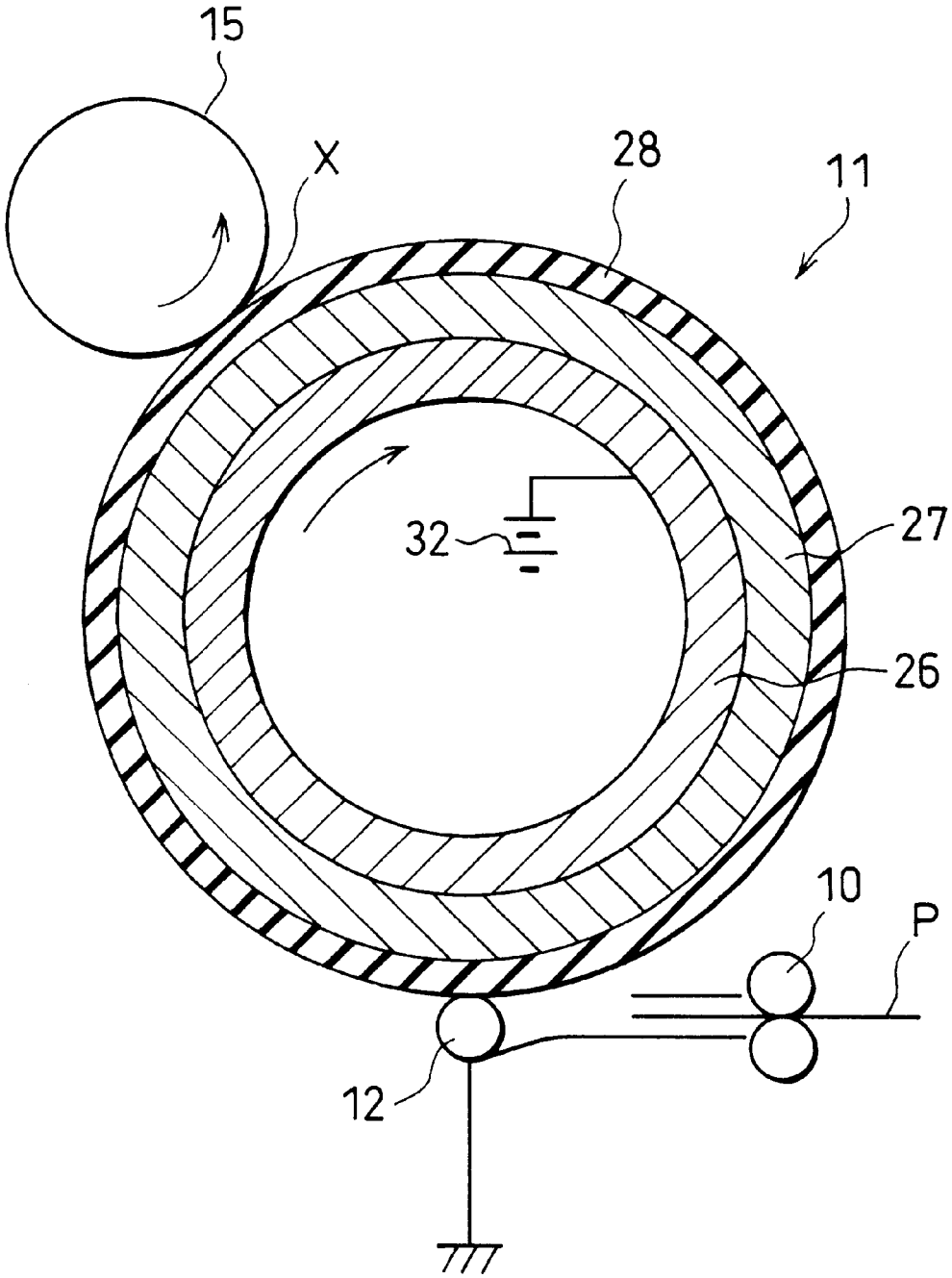
FIG. 1 is a view schematically showing an arrangement around a transfer drum provided in an image forming apparatus in accordance with an example embodiment of the present invention.

Next, the arrangement of the transfer drum 11 will be explained. As shown in FIG. 1, the transfer drum 11 includes a cylindrical conductor layer 26 made of aluminium as a base material, and an elastic semiconductor layer 27 is provided over the top surface of the conductor layer 26. Further, a dielectric layer 28 is provided over the top surface of the semiconductor layer 27. An elastic material, such as urethane rubber and elastomer, is used for the semiconductor layer 27, and a high polymer film, such as PVDF (polyvinylidene difluoride), is used for the dielectric layer 28.

Urethane rubber and elastomer maintain stable characteristics in any circumstance, and so the physical properties, such as volume resistivity, remain the same even when used under high temperature and high humidity/low temperature and low humidity circumstances. In addition, a power source section 32 serving as a voltage applying device is connected to the conductor layer 26, so that a voltage is applied throughout the conductor layer 26 in a stable manner.

Next, the mechanism of the electrostatic attraction of the transfer sheet P will be explained. The reason why the transfer sheet P is electrostatically attracted to the transfer drum 11 in the method of the present invention is because the charges of a polarity opposite to the polarity of a voltage applied to the conductor layer 26 are conferred to the transfer sheet P through contact charging. The contact charging is a combination of the Paschen discharge and charge injection mechanisms, which will be explained in the following.

Mechanism of Paschen Discharge

Figure 4:
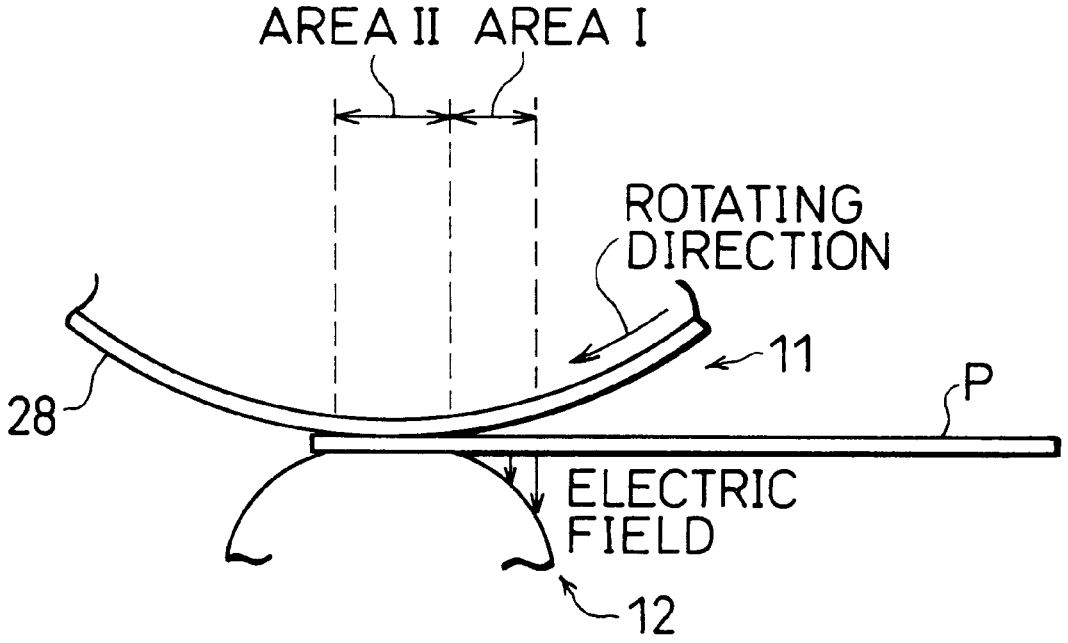
FIG. 4 is a view explaining areas for the Paschen discharge and the charge injection, respectively.

In Paschen discharge, a discharge is triggered when the G.R. 12 and dielectric layer 28 on the transfer drum 11 approximate to each other and aerial dielectric breakdown occurs as the electrical field intensity in the microscopic space between the G.R. 12 and dielectric layer 28 increases (area (I) in FIG. 4). Since a plus (minus) voltage is applied across the transfer drum 11 (dielectric layer 28) and G.R. 12 from the power source section 32, when the discharge is triggered under these conditions, minus (plus) charges are accumulated on the transfer sheet P at the transfer drum 11 side.

Mechanism of Charge Injection

When the discharge ends, the charge injection occurs at the nip between the transfer drum 11 and G.R. 12 (area (II) in FIG. 4), and the minus (plus) charges are further accumulated on the transfer sheet P at the transfer drum 11 side.

Figure 5:
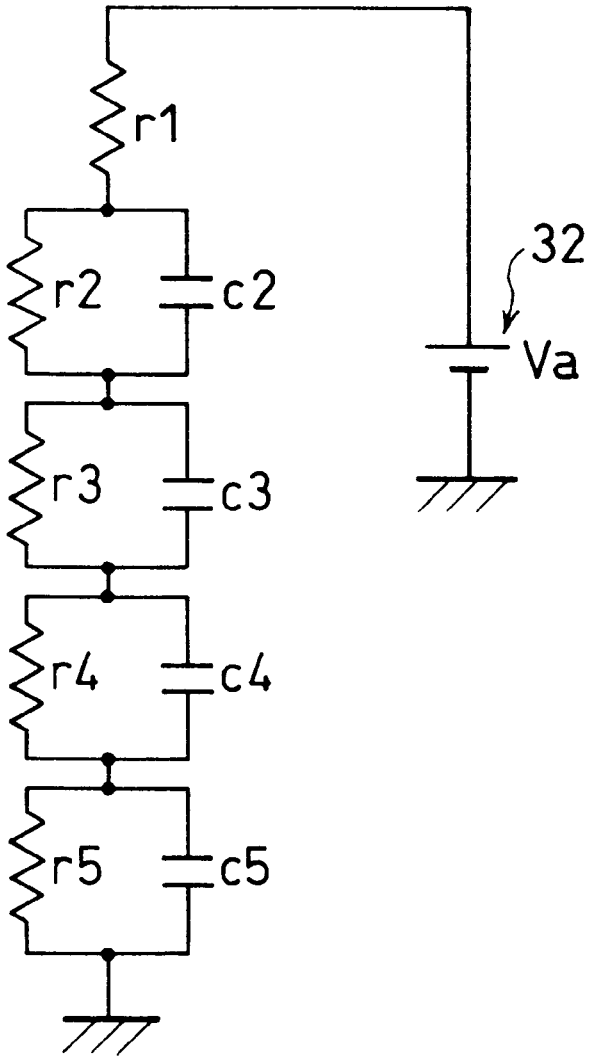
FIG. 5 is a view illustrating an equivalent circuit in each arrangement shown in FIG. 1 and 2 for the charge injection.

An equivalent circuit for the charge injection is illustrated in FIG. 5. In the drawing, Va represents an applied voltage from the power source section 32, r1 represents resistance of the semiconductor layer 27, r2 represents contact resistance between the semiconductor layer 27 and dielectric layer 28, r3 represents resistance of the dielectric layer 28, r4 represents contact resistance of the transfer sheet P, r5 represents contact resistance between the transfer sheet P and G.R. 12, c2 represents an electrostatic capacity between the semiconductor layer 27 and dielectric layer 28, c3 represents an electrostatic capacity of the dielectric layer 28, c4 represents an electrostatic capacity of the transfer sheet P, and c5 represents an electrostatic capacity between the transfer sheet P and G.R. 12.

To find an amount of charges (potential) accumulated on the transfer sheet P (c5 in the equivalent circuit), a potential difference (V) generated at c5 in the equivalent circuit is found using an amount of charges (potential) accumulated during the Paschen discharge as an initial potential. Hence, the charged potential of the transfer sheet P is computed as a total of the charged potentials accumulated during the Paschen discharge and charge injection. The analytic equation of the final charged potential V of c5 thus found is expressed as:

$$V = Ax(b' \times e^{B} - c' \times e^{C}) \tag{1}$$

where A, B, C, b' and c' are constants depending on the circuit. The charges (potential) accumulated on the transfer sheet P in the above manner shows the polarity opposite to the polarity of the voltage applied to the conductor layer 26. Thus, the electrostatic attraction force is developed between the transfer sheet P and conductor layer 26, and therefore, the transfer sheet P is electrostatically attracted to the transfer drum 11. Here, it is understood that the higher the charged potential on the transfer sheet P, the better the electrostatic attraction ability of the transfer drum 11.

Next, the electrostatic attraction force maintaining characteristics of the transfer sheet P will be explained. The charges (potential) accumulated on the transfer sheet P are assumed to attenuate as the time elapses. However, to keep attracting the transfer sheet P on the dielectric layer 28 electrostatically in a stable manner, it is important that the charges accumulated on the transfer sheet P are maintained without any attenuation. Thus, the attenuation characteristic of the charges on the transfer sheet P electrostatically attracted to the dielectric layer 28 is found as follows:

$$P \times \mathrm{V} + q \times \log(\mathrm{V}) = -\frac{t}{\varepsilon S} + N \tag{2}$$

where P and q are constants depending on the resistance value of each layer, t is an attenuation time of the charges on the transfer sheet P, $\epsilon$ is a specific dielectric constant of each layer, S is an area of the transfer sheet P, N is an integration constant, and V is a charged potential of the transfer sheet P.

From Equation (2) above, it is understood that the charged potential V on the transfer sheet P attenuates with the elapses of time t. Also, it is understood that the attenuation rate of the charges on the transfer sheet P depends on the specific dielectric constant and resistance value of each layer, and that the higher the specific dielectric constant and resistance value, the slower the attenuation rate.

In other words, it is assumed that the attenuation rate of the charges on the transfer sheet P can be slowed down when the transfer drum 11 is arranged to have a high resistance value either by increasing the thickness of the dielectric layer 28 or by adopting a multi-layer structure by providing an air layer between the dielectric layer 28 and semiconductor layer 27.

Figure 6:
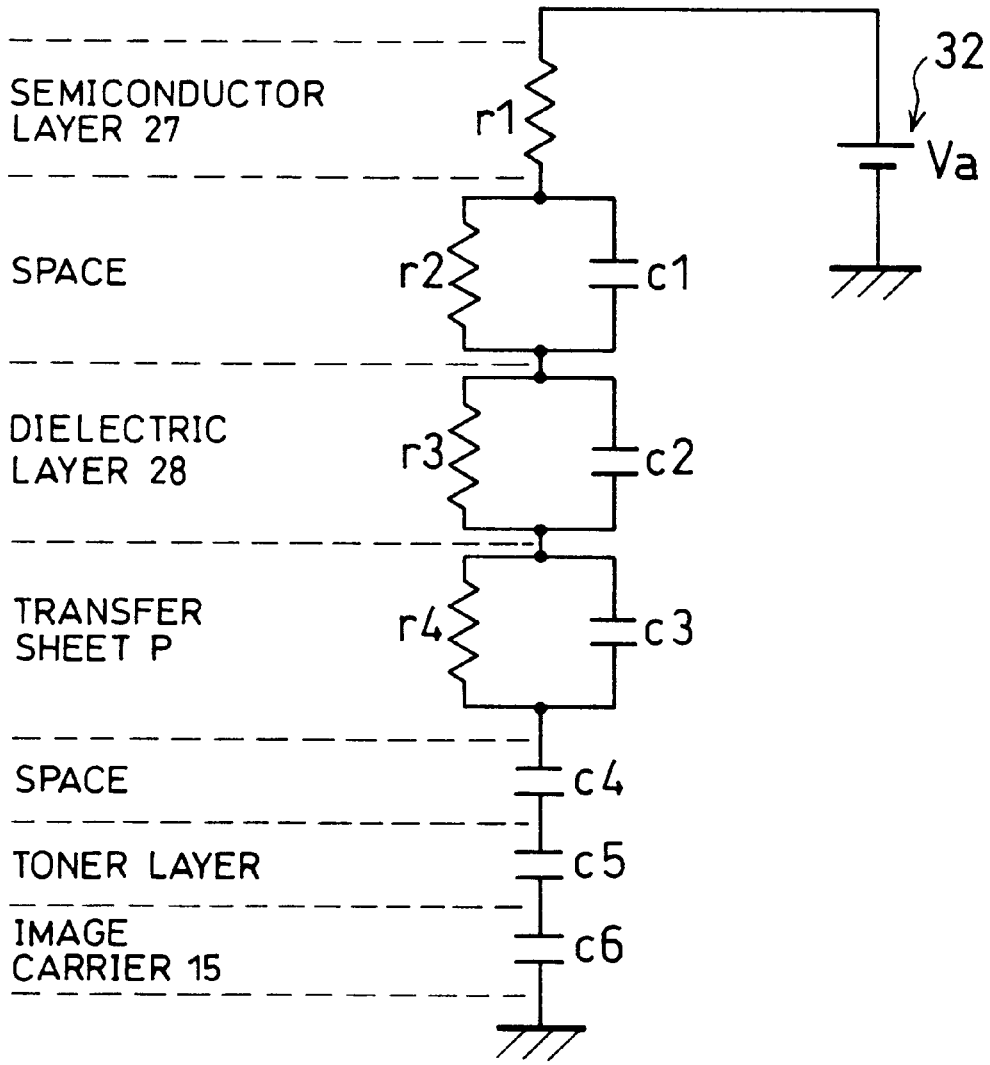
FIG. 6 is a view illustrating an equivalent circuit in each arrangement shown in FIG. 1 and 2 for toner transfer.
Figure 7:
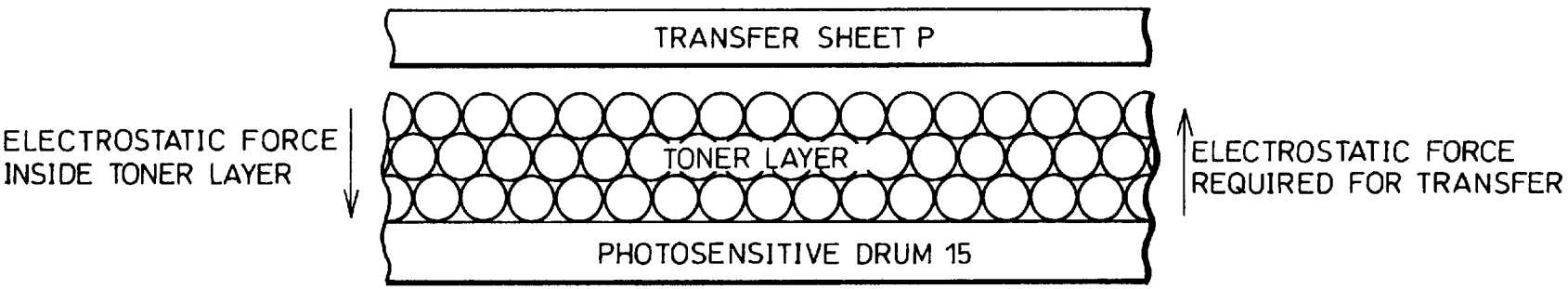
FIG. 7 is a model cross section showing an electrostatic force exerting inside a toner layer during the toner transfer.

Next, toner transfer mechanism from the image carrier to the transfer sheet P will be explained. To transfer the toner image formed on the photosensitive drum (image carrier) 15 onto the transfer sheet P, as shown in FIG. 7, an electrostatic force stronger than the electrostatic force currently exerting on the toner layer formed over the photosensitive drum 15 must be provided to the toner layer in an opposite direction. In FIG. 6, the higher the voltage applied to the toner layer, the more satisfactory the toner transfer.

Further, it is also important to apply the electrostatic force uniformly to the inner section of the toner layer. As has been explained in the prior art column, when the foam body is used as the semiconductor layer 27, the values of r2 and c1 in the space vary at the foam portion and the rest portion, and even if the same voltage is applied under these conditions, the electrostatic force applied to the inner section of the toner layer varies as well. In other words, a portion where the dielectric layer 28 and semiconductor layer 27 contact to each other tightly, the voltage does not drop considerably, thereby maintaining stronger electrostatic force (electrostatic force applied on the toner layer) for the transfer. On the other hand, when the foam portion of the semiconductor layer 27 and the dielectric layer 28 contact to each other, the potential drops at the space portion. This causes the voltage applied to the toner layer to drop, thereby reducing the electrostatic force for the transfer. Thus, when a toner image is transferred onto the transfer sheet P at the same toner density and the same applied voltage using the foam body as the semiconductor layer 27, a transferred image has less dense portion in the shape of the foam body of the semiconductor layer 27. As a result, unwanted spots appear on the transferred toner image, thereby deteriorating the image quality.

However, as shown in the present embodiment, when a solid body is used as the semiconductor layer 27, a constant voltage is always applied across the space between the transfer sheet P and toner layer when the toner image is transferred. Consequently, the toner image can be transferred in a stable manner, and a satisfactory image can be obtained.

Thickness of Dielectric Layer 28

An optimal thickness of the dielectric layer 28 layered over the solid semiconductor layer 27 is set forth in Table 1 below.

TABLE 1

| THICKNESS OF LAYER 28 (μm) | LESS THAN 75 | 75 | 100 | 150 | 200 | 250 | 300 | GREATER THAN 300 |
|---|---|---|---|---|---|---|---|---|
| ELECTROSTATIC ATTRACTION OF TRANSFER SHEET P | X | Δ | ○ | ○ | ○ | ○ | Δ | X |

(EFFECT
○: EXCELLENT
Δ: FAIR
X: POOR)

Table 1 reveals that the optimal thickness of the dielectric layer 28 is in a range between 75 μm and 300 μm inclusive. The dielectric layer 28 thinner than 75 μm is so thin that the resistance value drops and the attenuation rate of the charges on the transfer sheet P being electrostatically attracted is accelerated, thereby making it impossible to obtain stable attraction characteristics. On the other hand, the dielectric layer 28 thicker than 300 μm deteriorates the adhesion to the solid semiconductor layer 27, thereby making satisfactory electrostatic attraction of the transfer sheet P and the toner transfer impossible.

Figure 2:
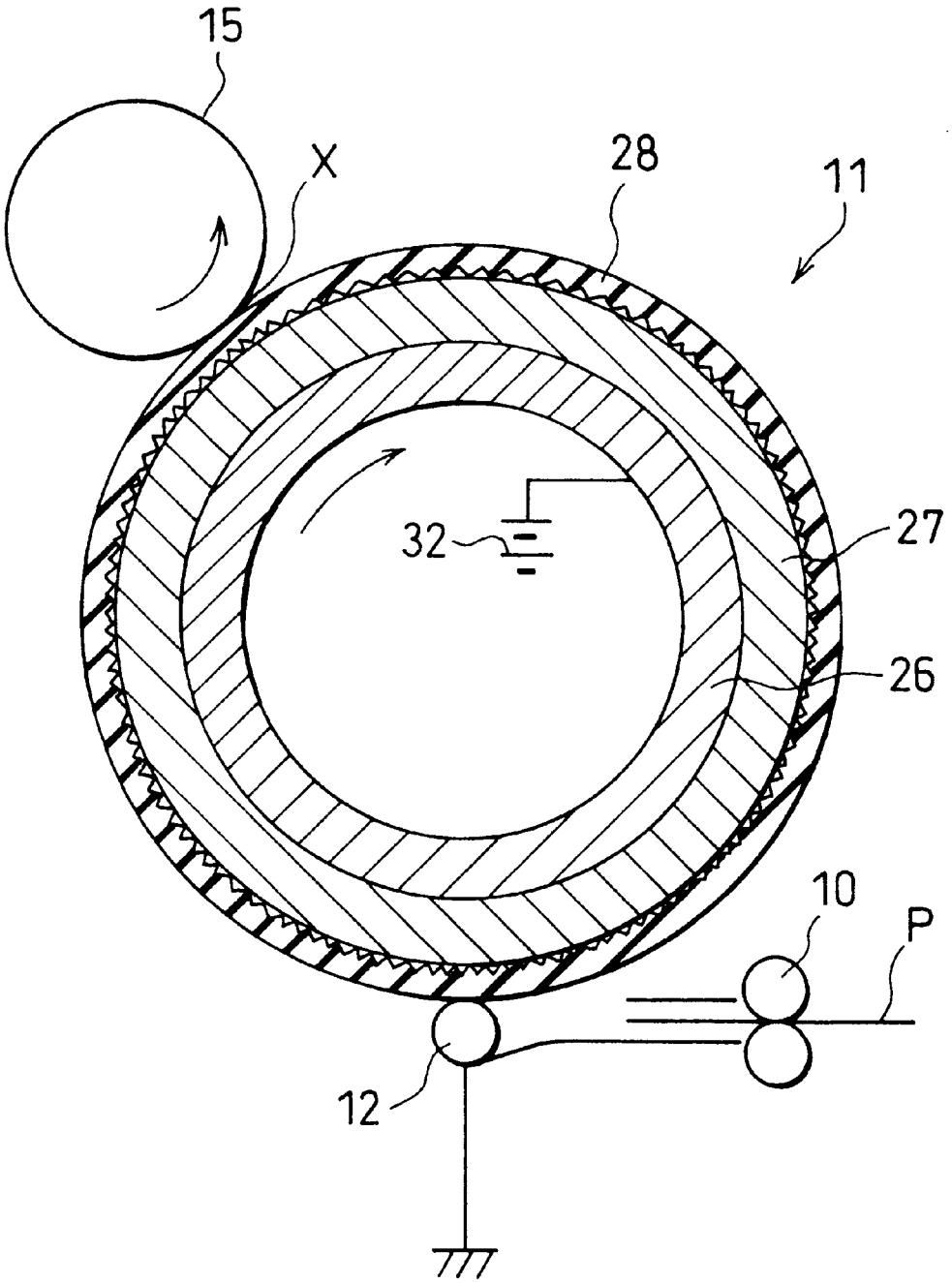
FIG. 2 is a view schematically showing an arrangement around a transfer drum provided in an image forming apparatus in accordance with another example embodiment of the present invention.

Besides thickening the dielectric layer 28, the resistance value can be increased to improve the attraction maintaining characteristics of the transfer sheet P by securing a microscopic space by providing irregularities to the dielectric layer 28 on the surface contacting to the semiconductor layer 27 as shown in FIG. 2. In this case, as set forth in Table 2 below, the dielectric layer 28 can be thinner compared with a case where the irregularities are not provided.

TABLE 2

| THICKNESS OF LAYER 28 (μm) | LESS THAN 50 | 50 | 100 | 120 | 160 | 180 | 200 | GREATER THAN 200 |
|---|---|---|---|---|---|---|---|---|
| ELECTROSTATIC ATTRACTION OF TRANSFER SHEET P | X | Δ | ○ | ○ | ○ | ○ | Δ | X |

(EFFECT
○: EXCELLENT
Δ: FAIR
X: POOR)

More specifically, Table 2 above reveals that an adequate thickness of the dielectric layer 28 is in a range between 50 μm and 200 μm inclusive. Here, the dielectric layer 28 thinner than 50 μm is too thin to have satisfactory durability; moreover, the attraction force maintaining effect with respect to the transfer sheet P deteriorates because the resistance value is too small. On the other hand, the dielectric layer thicker than 200 μm produces too high synthetic resistance of the space secured by the irregular portions and the thickness of the dielectric layer 28, and an amount of generated charges necessary for the electrostatic attraction is reduced. This makes the stable electrostatic attraction of the transfer sheet P and the toner transfer difficult.

Next, the results of an evaluation test of the electrostatic attraction force developed between the transfer drum 11 and the transfer sheet P with a variety of average intervals of the space secured by the irregularities provided to the dielectric layer 28 are set forth in Table 3 below. The effect of the attraction force is evaluated whether the transfer sheet P is electrostatically attracted to the transfer drum 11 in a stable manner while the transfer drum 11 rotates four times. Accordingly, it is discovered that the interval of the microscopic space should be set to a range between 20 μm and 50 μm to attract the transfer sheet P to the transfer drum 11 in a stable manner.

TABLE 3

| AVERAGE INTERVAL OF SPACE BETWEEN LAYERS 27 & 28 (μm) | LESS THAN 10 | 10 | 20 | 30 | 40 | 50 | 60 | 70 OR GREATER |
|---|---|---|---|---|---|---|---|---|
| ELECTROSTATIC ATTRACTION OF TRANSFER SHEET P | X | X | ○ | ○ | ○ | ○ | X | X |

(EFFECT
○: EXCELLENT
X: POOR)

Figure 8:
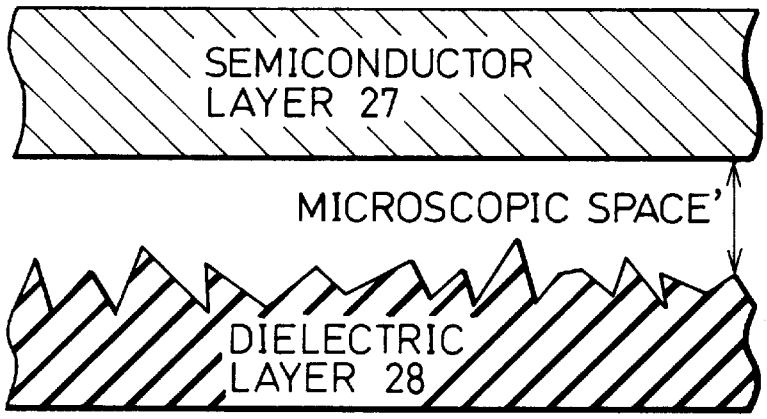
FIGS. 8(*a*) and 8(*b*) are views explaining a method of finding an average interval of a microscopic space.
Figure 8:
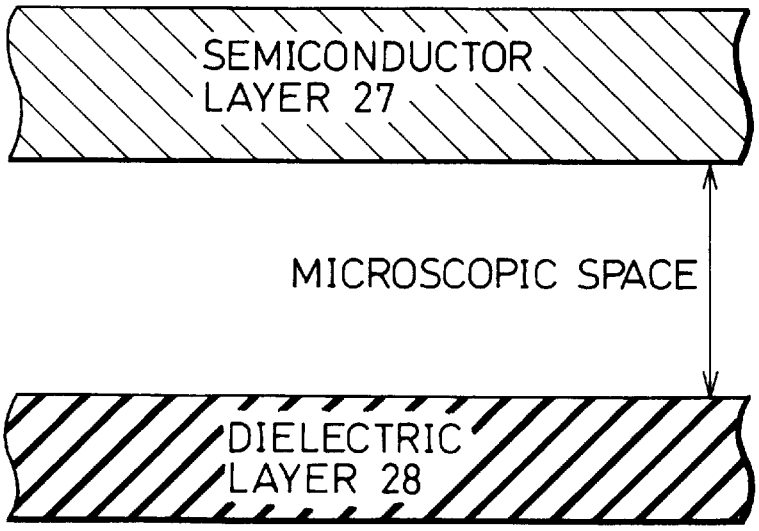

Here, a computing method of an average interval of the space in Table 3 above, more particularly, a computing method of a microscopic space when the irregularities are provided to the dielectric layer 28 on the surface touching the solid semiconductor layer 27, will be explained. FIG. 8(*a*) illustrates a model of an actual microscopic space' between the semiconductor layer 27 and dielectric layer 28. An average interval of the space between the semiconductor layer 27 and dielectric layer 28 used in the present invention is an average interval of the microscopic space' between the semiconductor layer 27 and dielectric layer 28 of FIG. 8(*a*) (an average interval value of the actual microscopic space) (FIG. 8(*b*)).

Figure 9:
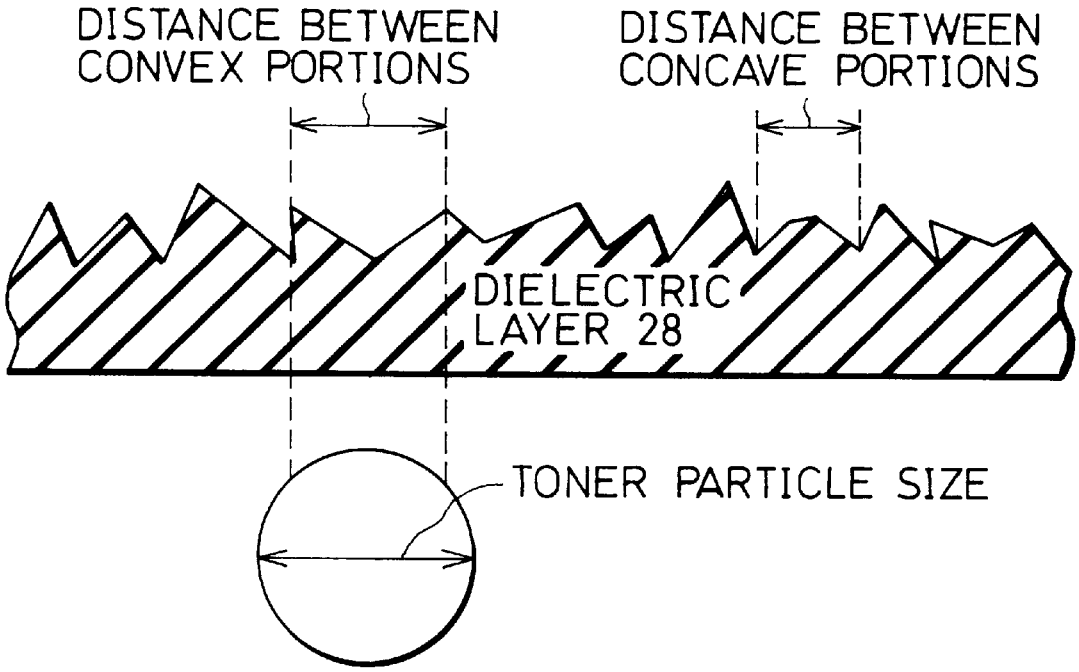
FIG. 9 is a cross section showing a distance between convex portions and a distance between concave portions of irregularities provided on a dielectric layer.

Further, the irregularities on the dielectric layer 28 will be explained with reference to FIG. 9. To prevent the inconsistencies in the density of the toner image caused by the microscopic space, it is preferable to make the (maximum) distance between the convex portions, or the (maximum) distance between the concave portions, smaller than a toner particle size.

If the distance between the concave portions or the distance between the convex portions is set larger than the toner particle size, defective toner transfer occurs at the concave portions or convex portions, and the density drops at those particular portions. Consequently, the resulting image may have a shape of the concave portions or convex portions. This happens in the same mechanism as the one explained in the mechanism of the toner transfer above when the foam body is used as the semiconductor layer 27. However, if the dielectric layer 28 is arranged to have the above distance smaller than the toner particle size, as is apparent from FIG. 9, each individual toner particle can be transferred in a secure manner. Thus, the shape of the concave or convex portion is not reproduced when an image is formed. Consequently, a high-quality toner image without deterioration of the image quality or inconsistencies in the density can be obtained.

Thus, if the irregularities are provided to the dielectric layer 28 on the surface touching the solid semiconductor layer 27, the electrostatically attracted transfer sheet P can be kept attracted in a stable manner while a toner image is transferred, thereby achieving the same effect as the one attained when a combination of the thick dielectric layer 28 without irregularities and the solid semiconductor layer 27 is used.

Method of Forming Irregularities on Dielectric Layer 28

Figure 10:
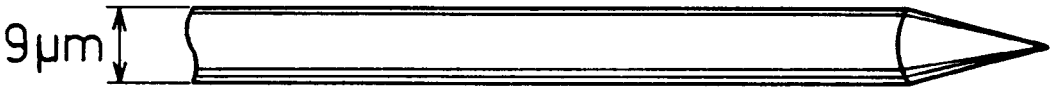
FIG. 10 is a view showing a method of providing the irregularities on the dielectric layer, and it is a perspective view showing the configuration of one fiber used to provide the irregularities.
Figure 11:
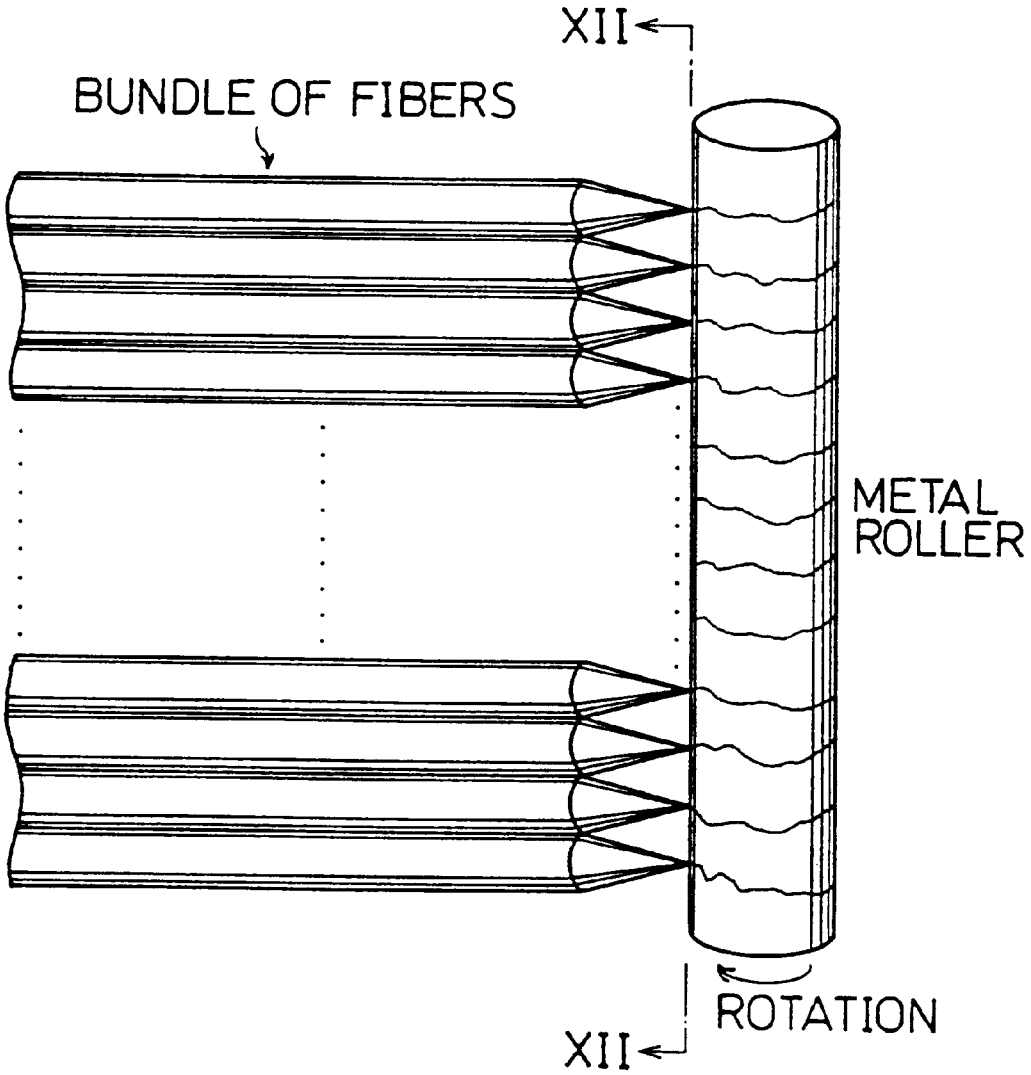
FIG. 11 is a view showing a method of providing the irregularities on the dielectric layer, and it is a perspective view showing a bundle of the fibers and a metal roller used to provide the irregularities.
Figure 12:
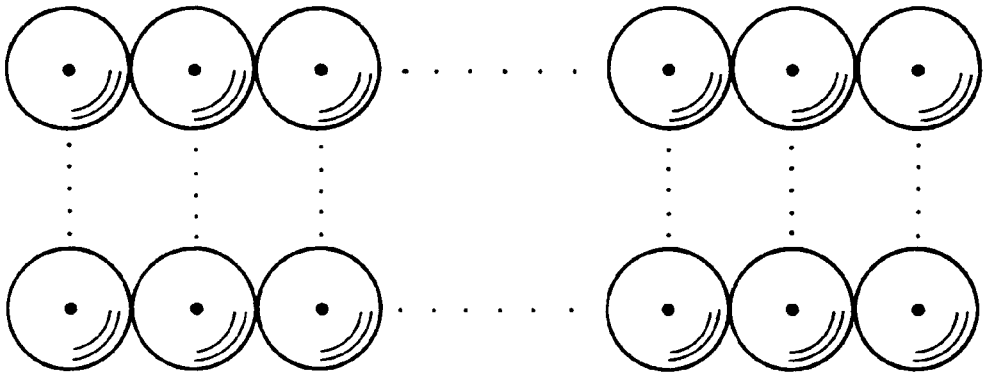
FIG. 12 is a view showing a method of providing the irregularities on the dielectric layer, and it is a plan view showing the bundle of the fibers taken along A—A line in FIG. 11.

Glass or metal fibers with a sharp point as shown in FIG. 10 are bundled and one of a pair of metal rollers is rotated so that its surface is scratched by the sharp points (FIG. 11). FIG. 12 is a front view of the bundle of the fibers. In the present embodiment, a fiber having a diameter of about 9 $\mu$m is used on the assumption that the toner particle size is about 9 $\mu$m.

Further, the dielectric layer 28 is sandwiched by the pair of metal rollers one of which has scratched on the surface, whereby predetermined irregularities are formed on one of the surfaces of the dielectric layer 28. Note that the diameter of the fiber is not limited to 9 $\mu$m, and it can be equal to or smaller than the toner particle size. Also, the above irregularities forming method is only an example, and any method is applicable as long as satisfactory irregularities are obtained.

Volume Resistivity and Thickness of Semiconductor Layer 27

From Table 4 below, it is understood that optimal volume resistivity of the semiconductor layer 27 is in a range between $10^6$ Ωcm and $10^{11}$ Ωcm

TABLE 4

| VOLUME RESISTIVITY OF SEMICONDUCTOR LAYER 27 | LESS THAN $10^6$ | $10^6$ | $10^8$ | $10^{10}$ | $10^{11}$ | GREATER THAN $10^{11}$ |
|---|---|---|---|---|---|---|
| TONER TRANSFER CHARACTERISTICS | X | Δ | ○ | ○ | Δ | X |

(EFFECT
○: EXCELLENT
Δ: FAIR
X: POOR)

FIG. 4 reveals that when the volume resistivity of the semiconductor layer 27 is smaller than $10^6$ Ωcm, too much current is flown during the toner transfer, causing reverse transfer to occur. The reverse transfer referred herein means a phenomenon that the toner transferred onto the transfer sheet P is returned to the photosensitive drum 15. On the other hand, when the volume resistivity of the semiconductor layer 27 is greater than $10^{11}$ Ωcm, the obtained electrostatic force is insufficient for the toner transfer, thereby causing defective transfer. In short, it is understood that optimal volume resistivity of the semiconductor layer 27 is in a range between $10^6$ Ωcm and $10^{11}$ Ωcm.

Also, it is understood from Table 5 below that an optimal thickness of the semiconductor layer 27 of the present invention is in a range between 3 mm and 9 mm.

TABLE 5

| THICKNESS OF SEMICONDUCTOR LAYER 27 (mm) | LESS THAN 3 | 3 | 5 | 6 | 8 | 9 | GREATER THAN 9 |
|---|---|---|---|---|---|---|---|
| ELECTROSTATIC ATTRACTION OF TRANSFER SHEET P | X | Δ | ○ | ○ | ○ | Δ | X |

(EFFECT
○: EXCELLENT
Δ: FAIR
X: POOR)

The semiconductor layer 27 thinner than 3 mm is not practically available because of poor durability. On the other hand, the semiconductor layer 27 thicker than 9 mm is too thick to obtain smooth contact with the conductor layer 26; moreover, the major diameter accuracy is deteriorated. Thus, the transfer sheet P can not be electrostatically attracted in a stable manner.

Hardness of Semiconductor Layer 27

Here, a nip time during the transfer is determined by Wn/St, where Wn is a nip width formed between the transfer drum 11 and photosensitive drum 15 and St is a rotational speed of the transfer drum 11. It means that the nip time can be adjusted by adjusting the nip width Wn by changing the hardness of the semiconductor layer 27.

The relation between the hardness of the semiconductor layer 27 and the electrostatic attraction of the transfer sheet P is set forth in Table 6 below. As can be understood, the hardness of the semiconductor layer 27 is preferably in a range between 20 and 80 inclusive, and more preferably in a range between 25 and 50 inclusive, in the unit of ASKER C, which is a unit series defined by Japanese Rubber Association. With the standard of ASKER C, when the depth of indentation produced by a ball-point needle with the application of load of 55 g on the spring becomes equal to the maximum displacement of the needle, the hardness of a sample is indicated as zero degree. Also, when the depth of indentation produced by the application of load of 855 g is zero, the hardness of the sample is indicated as one hundred degree.

TABLE 6

| HARDNESS OF SEMICONDUCTOR LAYER 27 (ASKER C) | 10 | 20 | 25 | 30 | 40 | 50 | 60 | 70 | 80 | 90 |
|---|---|---|---|---|---|---|---|---|---|---|
| ELECTROSTATIC ATTRACTION OF TRANSFER SHEET P | X | Δ | ○ | ○ | ○ | ○ | Δ | Δ | X | X |

(EFFECT
○: EXCELLENT
Δ: FAIR
X: POOR)

Here, mechanical factors are the reason why the above range is preferable. To be more specific, when the hardness of the semiconductor layer 27 is below 20, it is so soft that the transfer sheet curls in a backward direction (a direction to move away from the transfer drum 11 during the transfer). On the other hand, when the hardness of the semiconductor layer 27 is above 80, it becomes difficult to secure an adequate nip width between the transfer drum 11 and photosensitive drum 15, and the nip width becomes too large. As a consequence, the transfer drum 11 and the photosensitive drum 15 can not touch with each other smoothly, thereby shortening the operating life of the photosensitive drum 15. Thus, it is preferable to form the semiconductor layer 27 so that its hardness is within in the above-specified range.

Method of Sealing End Portion of Semiconductor Layer 27 with Dielectric Layer 28

Figure 13:
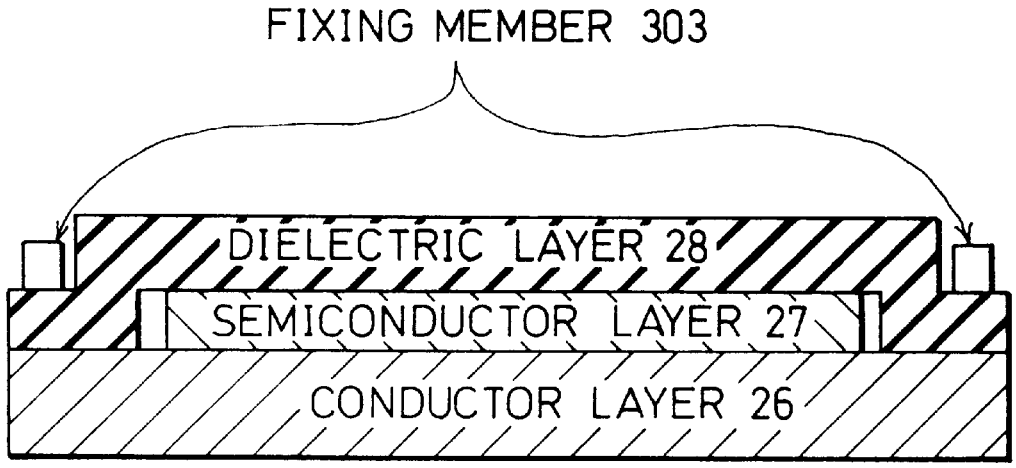
FIG. 13 is a view showing a method of fixing a semiconductor layer with the dielectric layer, and it is a cross section in the axis direction of a transfer drum.

FIG. 13 is a cross section of the transfer drum 11 in the axis direction. The end portion of the semiconductor layer 27 in the axis direction of the transfer drum 11 is covered with the dielectric layer 28 and fixed with a fixing member 303, so that air does not enter in a space between the dielectric layer 28 and conductor layer 26. This arrangement can prevent the collection of water drops between the layers under high humidity circumstances. Thus, the stable electrostatic attraction characteristics can be maintained in any circumstance, thereby always realizing satisfactory toner transfer.

Figure 14:
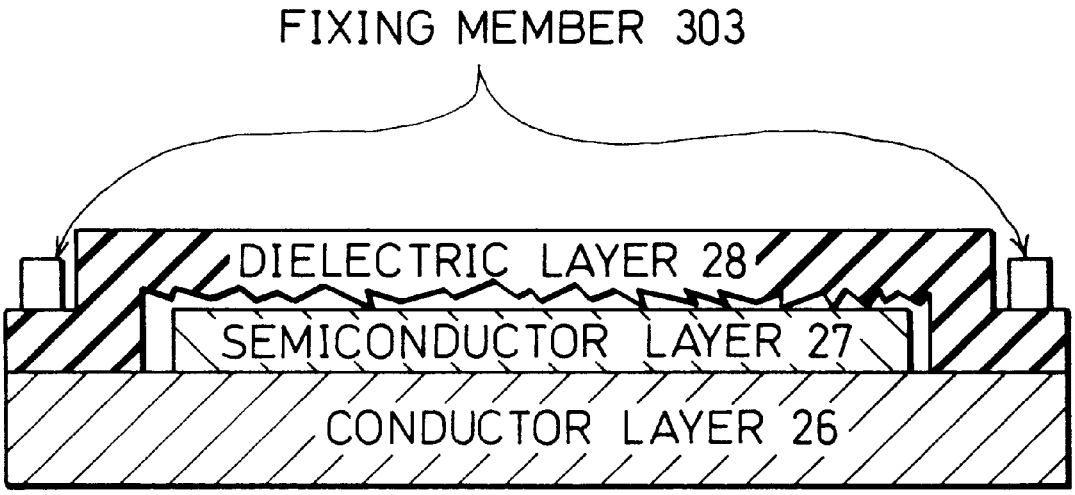
FIG. 14 is a view showing a method of fixing the semiconductor layer with the dielectric layer, and it is a cross section in the axis direction of another transfer drum.
Figure 15:
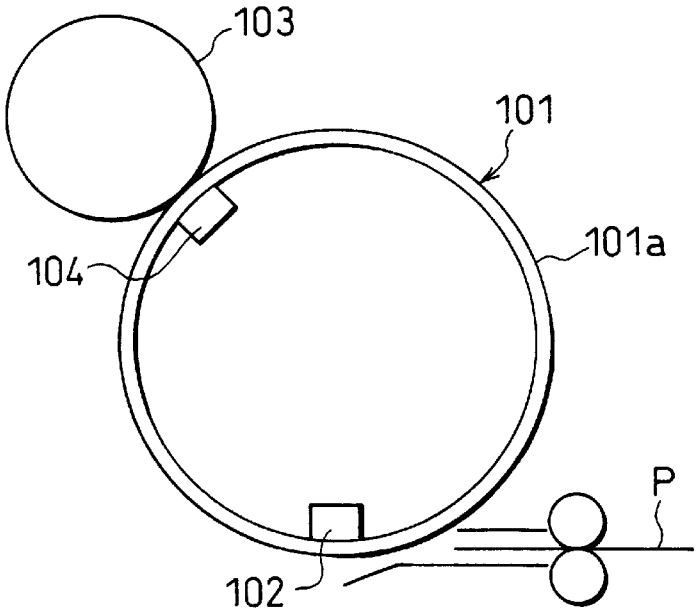
FIG. 15 is a view of a prior art, and it is a view schematically showing an arrangement around a transfer drum provided in an image forming apparatus.
Figure 16:
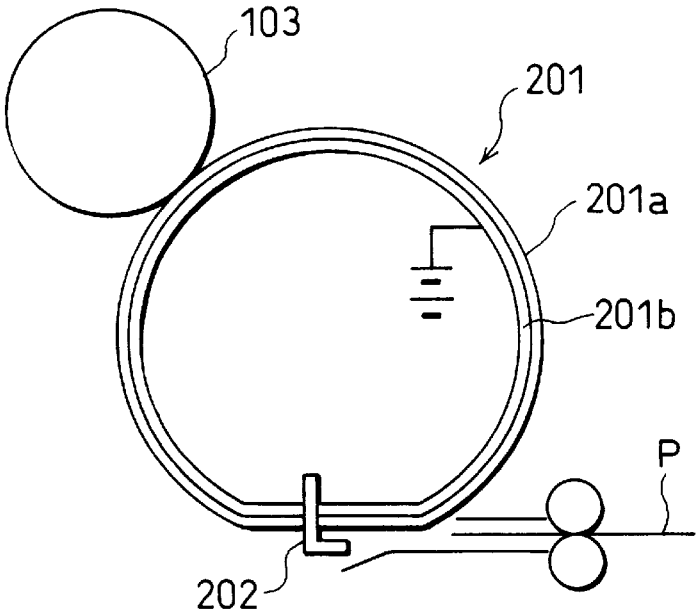
FIG. 16 is a view of another prior art, and it is a view schematically showing an arrangement around a transfer drum provided in an image forming apparatus.

FIG. 14 is a view showing the semiconductor layer 27 whose end portion is covered with the dielectric layer 28 provided with the irregularities on its surface touching the semiconductor layer 27. The end portion is fixed with the fixing member 303 so that air does not enter in a space between the dielectric layer 28 and conductor layer 26. This arrangement can prevent the collection of water drops between the layers under high humidity circumstances. Thus, the stable electrostatic attraction characteristics can be maintained in any circumstance, thereby always realizing satisfactory toner transfer.

As has been explained, an image forming apparatus of the present invention comprising an image carrier on a surface of which a toner image is formed, and a transfer device for transferring said toner image onto a transfer material by bringing said transfer material into contact with said image carrier while electrically attracting and holding said transfer material, is characterized in that:

(I) said transfer device includes, (a) a dielectric layer, a semiconductor layer, and a conductor layer, which are sequentially layered vertically from a surface side touching said transfer material, (b) a grounded electrode member touching a surface of said dielectric layer at an upstream side from a transfer position through said transfer material, and (c) a voltage applying device for applying a certain voltage to said conductor layer; and (II) said semiconductor layer is a solid elastic body.

According to the above arrangement, when the grounded electrode member, such as a conductive roller, touches the transfer device, such as a transfer drum, through the transfer material while a voltage is applied to the conductor layer, charges having a polarity opposite to the polarity of the voltage applied to the conductor layer are generated on the transfer material. Consequently, the transfer material can be electrostatically attracted to the dielectric layer. Here, since the voltage is applied to the conductor layer, the electrostatic attraction of the transfer material and the toner transfer can be carried out using the same power source.

According to the above arrangement, different from the prior art where the attraction of the transfer material and the transfer are carried out by the charge injection to a transfer material carrier through an aerial discharge, the attraction of the transfer material and the transfer are carried out by injecting the charges to the transfer material through the contact charging. Thus, a lower voltage can be used, and so the voltage can be readily controlled; moreover, the ozone emission can be suppressed to a relatively low level. Further, since the toner transfer and electrostatic attraction of the transfer material can be carried out using a single power source, the apparatus can be downsized and less expensive.

For example, in case of the toner transfer using a corona charger, it is necessary to apply a voltage of about 2.0 kV–3.5 kV. However, in accordance with the present invention, to obtain an image of the same image quality, the necessary voltage can be reduced by about 500V to about 1.0 kV–3.0 kV. Since the voltage applied to each section during the transfer can be reduced in the above manner, the image forming apparatus does not change much over time and the durability can be improved even when the image forming apparatus is driven continuously for a long period.

Also, since the semiconductor layer is made of an elastic body, it has become possible to always secure a predetermined transfer nip between the image carrier, such as the photosensitive drum, and the above transfer device. Thus, the image quality can be upgraded compared with a case where the semiconductor layer does not have elasticity, that is, when the image carrier and transfer device contact to each other linearly. More specifically, the photosensitive drum and transfer device are brought into contact with each other for a predetermined time to secure a predetermined transfer nip therebetween, and a larger electrical field is developed compared with a case of the linear contact. Consequently, the largest transfer electrical field is developed, which enables the toner on the image carrier to transfer onto the transfer material, thereby making the toner transfer very smooth.

Further, since the semiconductor layer is made of a solid elastic material, the adhesion between the dielectric layer and semiconductor layer improves compared with a case where the semiconductor layer is made of a foam elastic body. Thus, a voltage is applied more uniformly on the back surface of the dielectric layer that electrostatically attracts the transfer material, and therefore, the transfer material is electrostatically attracted in a stable manner. Also, since a constant voltage can be always applied across the individual toner particles and transfer material, there can be attained an effect that a high-quality toner transfer image without image deficiency, such as inconsistencies in density, can be obtained.

In addition, since the semiconductor layer is solid, which is more resistant to change in circumstances, the attenuation rate characteristics can be maintained regardless of its elasticity when the charges injected to the transfer material decreases without being affected by the change in circumstances.

Further, in the above arrangement, it is preferable that a thickness of the dielectric layer is in a range between 75 $\mu$m and 300 $\mu$m. According to this arrangement, the adhesion between the semiconductor layer and dielectric layer can be maintained while suppressing the attenuation rate of the charges on the transfer material. Consequently, the transfer material electrostatically attracted to the dielectric layer can be kept attracted and held more stably during the toner transfer, while making it possible to obtain a further improved high-quality transferred toner image.

Also, it is preferable that a thickness of the semiconductor layer is in a range between 3 mm and 9 mm. According to this arrangement, the semiconductor layer can maintain not only the contact to the conductor layer, but also the durability, while the major diameter accuracy of the entire transfer device is maintained. Consequently, the toner transfer can be carried out more stably and a further improved high-quality toner image can be obtained.

Further, it is preferable that the volume resistivity of the semiconductor layer is in a range between $10^6$ Ωcm and $10^{11}$ Ωcm. According to this arrangement, the reverse transfer and defective transfer can be prevented during the toner transfer. Consequently, the toner transfer can be carried out more stably and a further improved high-quality toner image can be obtained.

In addition, the irregularities may be provided to the dielectric layer on the surface touching the semiconductor layer. When arranged in this manner, a sufficient attraction effect can be obtained when the dielectric layer is made thinner compared with a case where the dielectric layer touches the semiconductor layer at a flat surface. Consequently, the transfer material electrostatically attracted to the dielectric layer can be kept attracted and held in a stable manner during the toner transfer, and a high-quality transferred toner image can be obtained without image quality deterioration by using the solid semiconductor layer.

When the irregularities are provided, it is preferable that a thickness of the dielectric layer is in a range between 50 μm and 200 μm. According to this arrangement, the transfer material electrostatically attracted to the dielectric layer can be kept attracted and held in a stable manner during the toner transfer.

Further, it is preferable that an average interval of the space secured by the irregularities provided to the dielectric layer on the surface touching the semiconductor layer is in a range between 20 μm and 50 μm. When arranged in this manner, the transfer material electrostatically attracted to the dielectric layer can be kept attracted and held in a stable manner during the toner transfer.

It is more preferable that at least one of a distance between concave portions and a distance between convex portions of the irregularities provided to the dielectric layer on the surface touching the semiconductor layer is smaller than a toner particle size of the toner image formed on the image carrier. According to this arrangement, although the electrostatic attraction effect of the transfer material is improved by securing the microscopic space with the irregularities, the irregularities do not cause any change in the electrostatic force applied to the individual toner particles. Consequently, a high-quality transferred toner image without image quality deterioration nor inconsistencies of the density can be obtained.

When the irregularities are provided, it is preferable that a thickness of the semiconductor layer is in a range between 3 mm and 9 mm. According to this arrangement, the semiconductor layer can maintain not only the contact to the conductor layer, but also the durability, while the major diameter accuracy of the entire transfer device is maintained. Consequently, the toner transfer can be carried out more stably and a further improved high-quality toner image can be obtained.

When the irregularities are provided, it is preferable that the volume resistivity of the semiconductor layer is in a range between $10^6$ Ωcm and $10^{11}$ Ωcm. According to this arrangement, the reverse transfer and defective transfer can be prevented during the toner transfer. Consequently, the toner transfer can be carried out more stably and a further improved high-quality toner image can be obtained.

Also, regardless of whether the irregularities are provided to the dielectric layer or not, it is preferable that the semiconductor layer is made of urethane rubber or elastomer. Because urethane rubber and elastomer are materials which can remain the same against the change in circumstances. Thus, the toner transfer can be carried out stably even under the high temperature and high humidity/low temperature and low humidity circumstances, thereby making it possible to maintain the high-quality toner transfer.

It is more preferable that, in the semiconductor layer and dielectric layer forming the transfer device, a width of the semiconductor layer in a rotating axis direction of the transfer device is smaller than a width of the dielectric layer, and an end portion of the semiconductor layer is covered with the dielectric layer. According to this arrangement, the collection of water drops between the layers under the high humidity circumstances can be prevented, and the stable electrostatic attraction characteristics can be maintained in any circumstance. Consequently, it has become possible to always carry out the toner transfer in a satisfactory manner.

An image method of the present invention is a method of forming a toner image characterized by comprising the steps of:

forming a toner image on a surface of an image carrier;

transferring the toner image formed on said image carrier onto a transfer material by electrically attracting and holding said transfer material by means of a transfer device including a dielectric layer, a semiconductor layer, and a conductor layer, which are sequentially layered vertically from a surface side touching said transfer material, and bringing said transfer material into contact with said image carrier;

grounding said transfer device by bringing an electrode member into contact with the surface of the dielectric layer at an upstream side from a transfer position through said transfer material; and applying a certain voltage to said conductor layer, wherein said semiconductor layer is a solid elastic body.

According to the above method, since the attraction of the transfer material and the transfer are carried out by injecting the charges to the transfer material through the contact charging, a lower voltage can be used during the attraction and the transfer. Also, since the toner transfer and electrostatic attraction of the transfer material can be carried out using a single power source, the apparatus can be downsized and less expensive. Further, since the semiconductor layer is the solid elastic body, when the charges injected to the transfer material attenuate in the grounding step, the attenuation rate characteristics can be maintained at a constant level against the change in circumstances regardless of its elasticity. In addition, a constant voltage is always applied to individual toner particles and transfer material during the transfer. Consequently, a high-quality transferred toner image can be obtained without image quality deterioration.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

an image carrier on a surface of which a toner image is formed, and a transfer device for transferring said toner image onto a transfer material by bringing said transfer material into contact with said image carrier while electrically attracting and holding said transfer material, (I) said transfer device includes, (a) a dielectric layer, a semiconductor layer, and a conductor layer, which are sequentially layered vertically from a surface side touching said transfer material, said dielectric layer having irregularities on a surface touching said semiconductor layer, (b) a grounded electrode member touching a surface of said dielectric layer at an upstream side from a transfer position through said transfer material, and (c) a voltage applying device for applying a certain voltage to said conductor layer; and (II) said semiconductor layer is a solid elastic body, wherein at least one of a distance between concave portions and a distance between convex portions of said irregularities provided to said dielectric layer on the surface touching said semiconductor layer is smaller than a toner particle size of said toner image formed on said image carrier.

2. An image forming apparatus comprising:

an image carrier on a surface of which a toner image is formed, and a transfer device for transferring said toner image onto a transfer material by bringing said transfer material into contact with said image carrier while electrically attracting and holding said transfer material, (I) said transfer device includes, (a) a dielectric layer, a semiconductor layer, and a conductor layer, which are sequentially layered vertically from a surface side touching said transfer material, a width of said semiconductor layer in a rotating axis direction of said transfer device is smaller than a width of said dielectric layer, and an end portion of said semiconductor layer is covered with said dielectric layer, wherein said transfer device further includes a fixing member for fixing an end portion of said dielectric layer, which covers the end portion of said semiconductor layer and is extended to a position to touch a surface of said conductor layer, so that air does not enter in a space between said dielectric layer and conductor layer.

* * * * *